US006305864B1

(12) United States Patent
Nguyen

(10) Patent No.: US 6,305,864 B1
(45) Date of Patent: Oct. 23, 2001

(54) WRITING IMPLEMENT SUPPORT SYSTEM

(76) Inventor: Michael H. Nguyen, 1400 Gandy Blvd. #507, St. Petersburg, FL (US) 33702

( * ) Notice: Subject to any disclaimer, the term of this patent is extended or adjusted under 35 U.S.C. 154(b) by 0 days.

(21) Appl. No.: 09/801,156

(22) Filed: Mar. 7, 2001

Related U.S. Application Data

(60) Provisional application No. 60/261,022, filed on Jan. 11, 2001.

(51) Int. Cl.[7] ..... B43K 23/04

(52) U.S. Cl. ..... 401/131; 401/98; 15/435; 206/214; 211/69.1; 211/69.5; 248/683

(58) Field of Search ..... 401/131, 48, 118, 401/88, 98; 15/435; 206/214; 211/69.1, 69.2, 69.3, 69.5; 248/683, 688, 146

(56) References Cited

U.S. PATENT DOCUMENTS 1,620,529 * 3/1927 Ferris ..... 401/131 X
4,944,624 * 7/1990 Garland ..... 401/131
6,142,432 * 11/2000 Amussen ..... 248/205.5
6,155,469 * 12/2000 Johnson et al. ..... 224/482
6,200,052 * 3/2001 Pitaniello ..... 401/131

* cited by examiner

*Primary Examiner*—Timothy L. Maust
*Assistant Examiner*—Kathleen J. Prunner

(57) ABSTRACT

A writing implement support system for releasably positioning a writing implement with respect to a recipient surface comprises a suction cup that has a generally hemispherical shape. The suction cup is configured to be compressed against a generally flat recipient surface. The compression forms a first bond having a holding force of an intermediate magnitude. A connector is located on the outer convex surface of the suction cup. A writing implement has a writing end and a non-writing end. A writing implement cap is configured to form a second bond with the writing implement. The second bond has a holding force of a weak magnitude. The cap is also configured to form a third bond with the connector. The third bond has a holding force of a strong magnitude.

7 Claims, 3 Drawing Sheets

WRITING IMPLEMENT SUPPORT SYSTEM

RELATED APPLICATION

This application is a continuation-in-part of now abandoned Provisional Application No. 60/261,022 filed Jan. 1, 2001.

BACKGROUND OF THE INVENTION

1. Field of the Invention

The present invention relates to a new and improved writing implement support system and more particularly pertains to releasably positioning a writing implement with respect to a recipient surface.

2. Description of the Prior Art

The use of other known methods and apparatuses for supporting writing implements is known in the prior art. More specifically, other known methods and apparatuses for supporting writing implements previously devised and utilized for the purpose of positioning a writing implement to a recipient surface are known to consist basically of familiar, expected, and obvious structural configurations, notwithstanding the myriad of designs encompassed by the crowded prior art which has been developed for the fulfillment of countless objectives and requirements.

By way of example, U.S. Pat. No. Des 377,193 to Takemura discloses a writing instrument and holder. U.S. Pat. No. 6,019,535 to Turner discloses a felt tip pen cover with eraser. United States Patent Number Des. 349,924 to Fisch discloses a combined pen and flag.

While these devices fulfill their respective, particular objectives and requirements, the aforementioned patents do not describe new and improved writing implement support system that allows releasably positioning a writing implement with respect to a recipient surface.

In this respect, the new and improved writing implement support system according to the present invention substantially departs from the conventional concepts and designs of the prior art, and in doing so provides an apparatus primarily developed for the purpose of releasably positioning a writing implement with respect to a recipient surface.

Therefore, it can be appreciated that there exists a continuing need for a new and improved new and improved writing implement support system which can be used for releasably positioning a writing implement with respect to a recipient surface. In this regard, the present invention substantially fulfills this need.

SUMMARY OF THE INVENTION

In view of the foregoing disadvantages inherent in the other known methods and apparatuses for support writing implements now present in the prior art, the present invention provides a new and improved writing implement support system. As such, the general purpose of the present invention, which will be described subsequently in greater detail, is to provide a new and improved writing implement support system and method which has all the advantages of the prior art and none of the disadvantages.

To attain this, the present invention essentially comprises a new and improved writing implement support system for releasably positioning a writing implement with respect to a recipient surface. The system comprises, in combination, a suction cup, a connector and a capped writing implement. The suction cup is fabricated of a flexible resilient elastomeric material and has a generally hemispherical shape. The internal radius of the suction cup is between about 1.0 and 2.0 inches. The cup comprises an inner concave surface and an outer convex surface with a circumferential circular edge there between. The suction cup has a center with a central axis there through. It is configured to be received on a generally flat and generally smooth recipient surface. The suction cup is configured to be compressed against the recipient surface to form a first bond having a holding force of an intermediate magnitude for retaining the suction cup adherent to the recipient surface during normal operation and use. Next is to provide a round, hollow, cylindrically shaped connector which is fabricated of a flexible resilient elastomeric material. The connector has an upper end and a lower end. The connector is located on the outer convex surface of the suction cup at the center of the convex surface. The longitudinal axis of the connector is aligned along the central axis of the suction cup. The connector has an internal surface and an external surface with an edge there between which forms a receiving aperture at the upper end. The connector has an axial length from the convex surface outwardly of between about 0.75 and 1.50 inches. The connector aperture has an open cross sectional internal diameter of between about 0.25 and 0.50 inches. Next provided is a writing implement. The writing implement has a writing end and a non-writing end. There is also a generally round cylindrical external gripping surface between the ends. Lastly there is provided a writing implement cap. The cap is fabricated of a generally rigid material, preferably a plastic. It has an internal cylindrical surface which is sized to receive and mate with and accommodate the external surface of the writing implement at the writing end. The coupling of the implement and the cap forms a second bond having a holding force of a weak magnitude for retaining the cap in position coupled with the writing implement. The cap also is configured and capable of being receivably accepted into, and securely held within, the internal diameter of the receiving aperture of the connector. The insertion of the cap into the connector forms a third bond having a holding force of a strong magnitude for securely retaining the cap within the connector during normal operation and use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is, therefore, an object of the present invention to provide a new and improved writing implement support system which has all of the advantages of the prior art other known methods and apparatuses and none of the disadvantages.

It is another object of the present invention to provide a new and improved writing implement support system which may be easily and efficiently manufactured and marketed.

It is a further object of the present invention to provide a new and improved writing implement support system which is of durable and reliable constructions.

An even further object of the present invention is to provide a new and improved writing implement support system which is susceptible of a low cost of manufacture with regard to both materials and labor, and which accordingly is then susceptible of low prices of sale to the consuming public, thereby making such new and improved writing implement support system economically available to the buying public.

Even still another object of the present invention is to provide a new and improved writing implement support system for releasably positioning a writing implement with respect to a recipient surface.

Lastly, it is an object of the present invention to provide a writing implement support system for releasably positioning a writing implement with respect to a recipient surface. The system comprises a suction cup that has a generally hemispherical shape. The suction cup is configured to be compressed against a generally flat recipient surface. The compression forms a first bond having a holding force of an intermediate magnitude. Next provided is a connector located on the outer convex surface of the suction cup. Also provided is a writing implement having a writing end and a non-writing end. Lastly, there is provided a writing implement cap which is configured to form a second bond with the writing implement. The second bond has a holding force of a weak magnitude. The cap is also configured to form a third bond with the connector. The third bond has a holding force of a strong magnitude.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
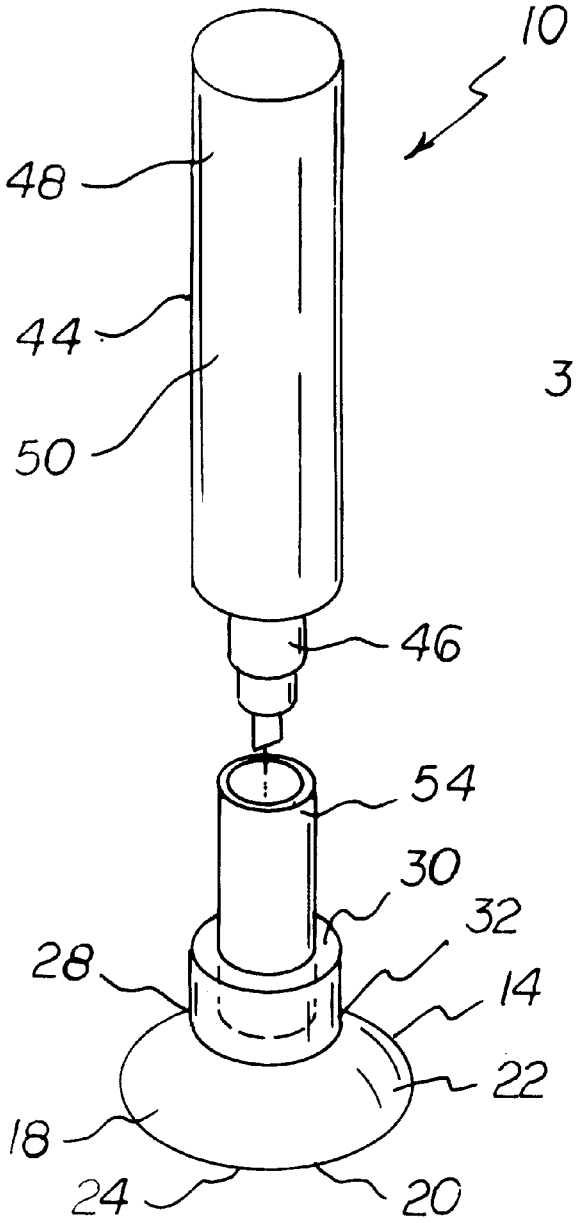
FIG. 1 is an exploded perspective view of the primary embodiment of the present invention.
Figure 2:
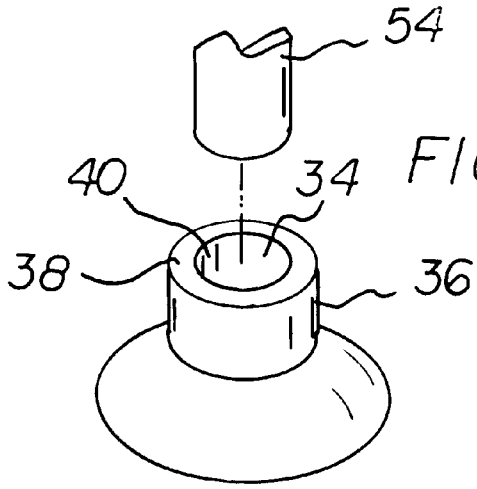
FIG. 2 is an exploded view of the suction cup and cap of the preferred embodiment of the present invention.

With reference now to the drawings, and in particular to FIG. 1 thereof, the preferred embodiment of the new and improved writing implement support system embodying the principles and concepts of the present invention and generally designated by the reference numeral 10 will be described.

The present invention, the new and improved writing implement support system 10 is comprised of a plurality of components. Such components in their broadest context include a suction cup, a connector, a writing implement and a writing implement cap. Such components are individually configured and correlated with respect to each other so as to attain the desired objective.

The writing implement support system 10 functions for releasably positioning a writing implement with respect to a recipient surface. The system comprises, in combination, a suction cup, a connector and a capped writing implement.

The suction cup 18 is fabricated of a flexible resilient elastomeric material and has a generally hemispherical shape. The internal radius of the suction cup is between about 1.0 and 2.0 inches, preferably 1.5 inches. The cup comprises an inner concave surface 20 and an outer convex surface 22 with a circumferential circular edge 24 there between.

The suction cup has a center with a central axis there through. It is configured to be received on a generally flat and generally smooth recipient surface 14. The suction cup is configured to be compressed against the recipient surface to form a first bond having a holding force of an intermediate magnitude for retaining the suction cup adherent to the recipient surface during normal operation and use.

Next is to provide a round, hollow, cylindrically shaped connector 28 which is fabricated of a flexible resilient elastomeric material. The connector has an upper end 30 and a lower end 32.

The connector is located on the outer convex surface of the suction cup at the center of the convex surface and is coupled to the suction cup outer surface. The longitudinal axis of the connector is aligned along the central axis of the suction cup.

The connector has an internal surface 34 and an external surface 36 with an edge 38 there between which forms a receiving aperture 40 at the upper end. The connector has an axial length from the convex surface outwardly of between about 0.75 and 1.50 inches. The connector aperture has an open cross sectional internal diameter of between about 0.25 and 0.50 inches.

Next provided is a writing implement 44. The writing implement has a writing end 46 and a non-writing end 48. There is also a generally round cylindrical external gripping surface 50 between the ends.

Lastly there is provided a writing implement cap 54. The cap is fabricated of a generally rigid material, preferably a plastic. It has an internal cylindrical surface which is sized to receive and mate with and accommodate the external surface of the writing implement at the writing end. The coupling of the implement and the cap forms a second bond having a holding force of a weak magnitude for retaining the cap in position coupled with the writing implement. The cap also is configured and capable of being receivably accepted into, and securely held within, the internal diameter of the receiving aperture of the connector. The insertion of the cap into the connector forms a third bond having a holding force of a strong magnitude for securely retaining the cap within the connector during normal operation and use.

During operation and use, the holding force between the writing implement and the cap is of a weaker magnitude than the force of intermediate magnitude between the suction cup and the recipient surface. This allows the user to secure the suction cup to any smooth recipient surface, horizontal or vertical or at any angle. The user may insert the writing implement into the cap and remove it repeatedly without overcoming the greater force between the suction cup and the recipient surface. The force of great magnitude between the suction cup and the cap is greater than the other two forces so no separation occurs there between during the inserting of the writing implement into the cap and its removal. Further, the present invention contemplates the lining up of a plurality of writing implements of different thicknesses and colors on a single recipient surface to allow writing and marking and coloring with a large number of writing implements which may be easily handled in a one handed operation.

Figure 3:
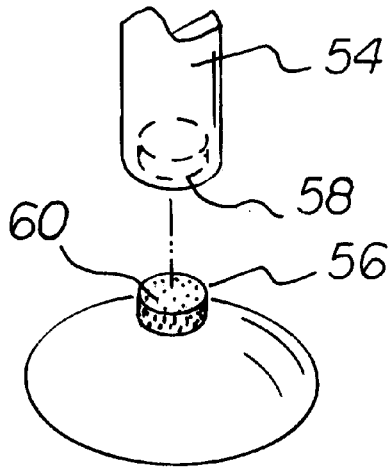
FIG. 3 is an exploded view of the alternate embodiment of the present invention where the cap and connector are coupled by an adhesive.

There are a variety of alternate embodiments associated with the present invention. In the first alternate embodiment the connector has an upper end with a knob 56 adapted to receive a recess 58 of the writing implement cap and is held in place by adhesive 60. Note FIG. 3.

Figure 4:
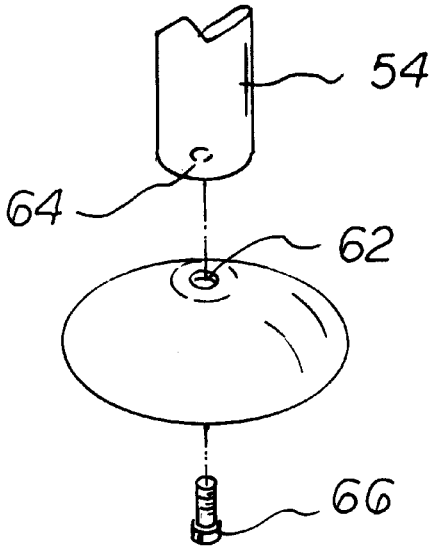
FIG. 4 is an exploded perspective view of an alternate embodiment of the present invention wherein the cap and connector are coupled by a threaded fastener.

A second alternate embodiment includes the connector having an upper end with an aperture 62 as well as a coaxial aperture 64 in the writing implement cap and being adapted to being coupled together by a threaded fastener 66. Note FIG. 4.

Figure 5:
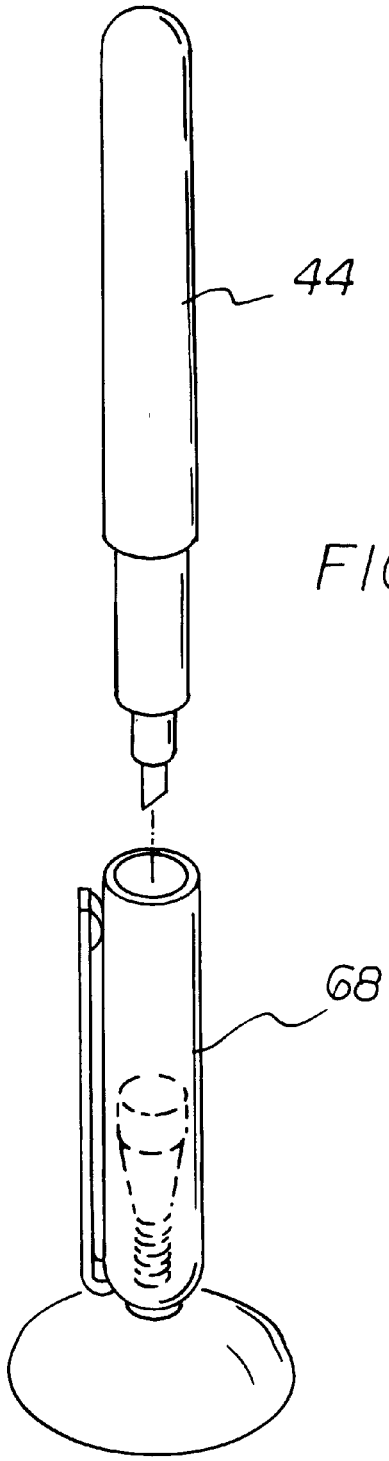
FIG. 5 is an exploded perspective view of an alternate embodiment wherein the cap and connector are a single integral component.

A third alternate embodiment of the present invention includes the connector and the writing implement cap being made as an integral component 68 from a single mold. Note FIG. 5.

Figure 6:
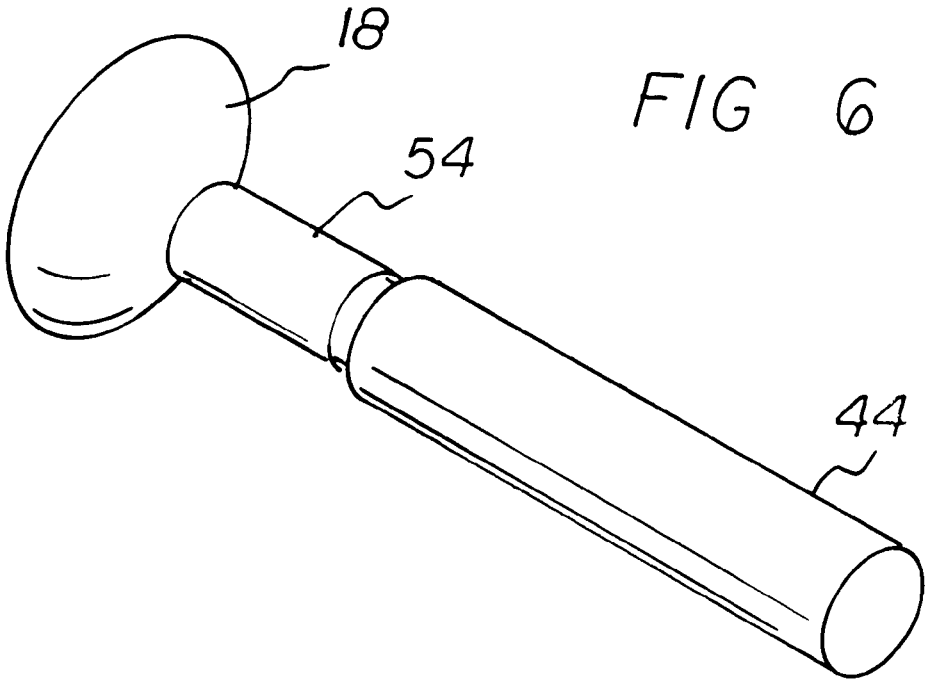
FIG. 6 is a perspective view of an alternate embodiment showing the suction cup, connector and writing implement with cap coupled together.
Figure 7:
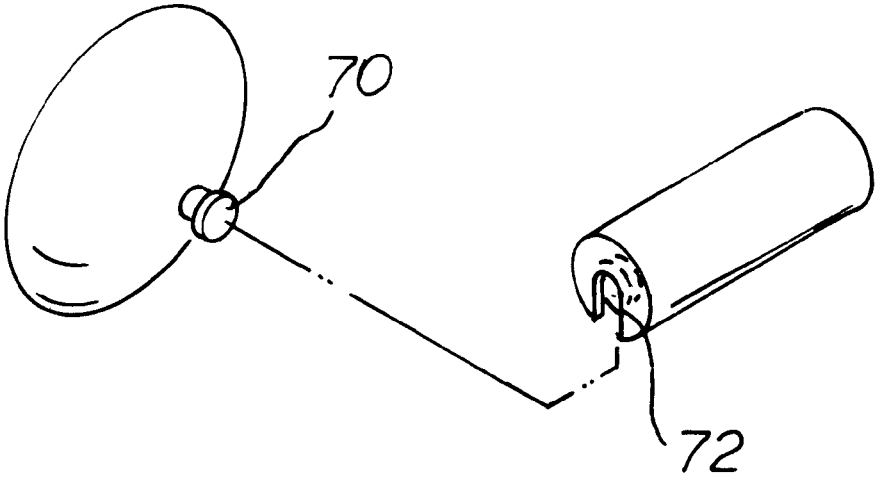
FIG. 7 shows the raised button and side slot attachment means between the suction cup and the connector in the FIG. 6 embodiment.

A fourth embodiment of the present invention includes the connector having an upper end with a raised knob 70 and a writing implement cap with an exposed side slot 72 being adapted to receive the raised knob. This embodiment is best utilized when the suction cup is placed in a vertical manner. Note FIGS. 6 and 7.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A writing implement support system for releasably positioning a writing implement with respect to a recipient surface comprising, in combination;

a suction cup fabricated of a flexible resilient elastomeric material having a generally hemispherical shape with an internal radius of between about 1.0 and 2.0 inches, with an inner concave surface and an outer convex surface with a circumferential circular edge there between and the suction cup having a center with a central axis there through, and being configured to be received on a generally flattened smooth recipient surface and adapted to be compressed against the recipient surface to form a first bond having a holding force of an intermediate magnitude for retaining the suction cup adherent to the recipient surface during normal operation and use;

a round, hollow, cylindrically shaped connector fabricated of a flexible resilient elastomeric material having an upper end and a lower end located on the outer convex surface of the suction cup at the center of the convex surface with the longitudinal axis of the connector aligned along the central axis of the suction cup, the connector having an internal surface and an external surface with an edge there between forming a receiving aperture at the upper end, the connector having an axial length from the convex surface outwardly of between about 0.75 and 1.50 inches with an open cross sectional internal diameter of the aperture being between about 0.25 and 0.50 inches;

the writing implement having a writing end and a non-writing end and a generally round cylindrical external gripping surface there between; and a writing implement cap being fabricated of a generally rigid plastic material, having an internal cylindrical surface which is sized to receive and mate with and accommodate the external surface of the writing implement at the writing end thereby forming a second bond having a holding force of a weak magnitude for retaining the cap in position coupled with the writing implement and the cap also being configured and capable of being receivably accepted into and securely held within the internal diameter of the receiving aperture of the connector, the insertion of the cap into the connector forming a third bond having a holding force of a strong magnitude for securely retaining the cap within the connector during normal operation and use.

2. A writing implement support system comprising;

a suction cup having a generally hemispherical shape with a center and a central axis there through, and being configured to be compressed against a generally flat recipient surface to form a first bond having a holding force of an intermediate magnitude;

a connector having an upper end and a lower end located on an outer convex surface of the suction cup;

a writing implement having a writing end and a non-writing end; and a writing implement cap configured to form a second bond with the writing implement having a holding force of a weak magnitude, the cap also being configured to form a third bond with the connector, the third bond having a holding force of a strong magnitude.

3. A writing implement support system of claim 2 wherein the upper end of the connector forms a hollow cylinder adapted to couple around the writing implement cap.

4. A writing implement support system of claim 2 wherein the upper end of the connector is coupled to the writing implement cap and being held in place by adhesive.

5. A writing implement support system of claim 2 wherein the upper end of the connector is provided with an aperture coaxial with an aperture of the writing implement cap and being adapted to being coupled together by a threaded fastener.

6. A writing implement support system of claim 2 wherein the connector and the writing implement cap are made of an integral component from a single mold.

7. A writing implement support system of claim 2 wherein the upper end of the connector is provided with a raised knob and the writing implement cap is provided with an exposed side slot adapted to receive the raised knob.

* * * * *